United States Patent [19]

Noel

[11] 4,452,058

[45] Jun. 5, 1984

[54] LATCH, IN PARTICULAR FOR AN AUTOMOBILE VEHICLE DOOR

[75] Inventor: Jean P. Noel, St. Die, France

[73] Assignee: Compagnie Industrielle de Mecanismes, Levallois Perret, France

[21] Appl. No.: 352,612

[22] Filed: Feb. 26, 1982

[30] Foreign Application Priority Data

Mar. 3, 1981 [FR] France ..... 81 04172

[51] Int. Cl.[3] ..... E05B 65/06; E05C 3/16

[52] U.S. Cl. ..... 70/137; 70/264; 292/201; 292/216

[58] Field of Search ..... 292/201, 216; 70/263, 70/264, 137

[56] References Cited

U.S. PATENT DOCUMENTS

| | | | |
|---|---|---|---|
| 3,751,088 | 8/1973 | Schlage | 292/201 |
| 3,751,950 | 8/1973 | Leger | 70/264 |
| 4,219,227 | 8/1980 | Grebner | 292/216 |

*Primary Examiner*—Robert L. Wolfe

[57] ABSTRACT

The latch comprises a latching mechanism, a locking mechanism, an electric motor actuating device for the locking mechanism and a key for manually actuating the locking mechanism and controlling the supply of current to the actuating device. The motor has an output gear which is located in the case of the latch and directly drives an element of the locking mechanism.

8 Claims, 6 Drawing Figures

LATCH, IN PARTICULAR FOR AN AUTOMOBILE VEHICLE DOOR

The present invention relates to a latch, in particular for an automobile vehicle door, of the type comprising a latching mechanism, a locking mechanism, locking mechanism actuating means having an electric motor, and a manual actuating key for the locking mechanism and the control of the electric supply to the actuating means. These latches are in particular employed in vehicles having a central control for locking or unlocking all the doors.

In the known latches of this type, an actuating means having an electric motor is associated with a manually controlled conventional latch and connected by a linkage to the elements of the locking mechanism located inside the case of the latch. This results in high cost and great weight of the assembly comprising the latch and the actuating means and a relatively large overall size of this assembly which renders it difficult to dispose it in the doors of vehicles.

An object of the invention is to integrate the actuating means in the latch so as to reduce the weight, the overall size and the cost of the assembly.

The invention therefore provides a latch of the aforementioned type, wherein the output gear of the motor is located in the case of the latch and directly drives an element of the locking mechanism.

Also for the purpose of integrating the actuating means in the latch, it is advantageous to arrange that the key be connected to a supply switching lever of the actuating means, this lever carrying a metal strip which is applied elastically against a printed circuit carried by the case of the latch.

In order to simplify the construction, it is desirable to arrange that the switching lever constitute also the manual input element of the locking mechanism. In this case, the key is advantageously connected to the switching lever which is itself connected to the element engaged by the output gear of the motor through a connection having a lost travel at least in each of the locking and unlocking positions of the locking mechanism. Indeed, the key then never drives itself the motor output gear in rotation and the manual control is very smooth.

If in addition the switching lever has a single stable position which is its inoperative median position, this lever may itself act as a distributor for supplying current to all the actuating means of the vehicle.

The invention will be described in more detail hereinafter with reference to the accompanying drawings, which show only two embodiments. In the drawings.

Figure 1:
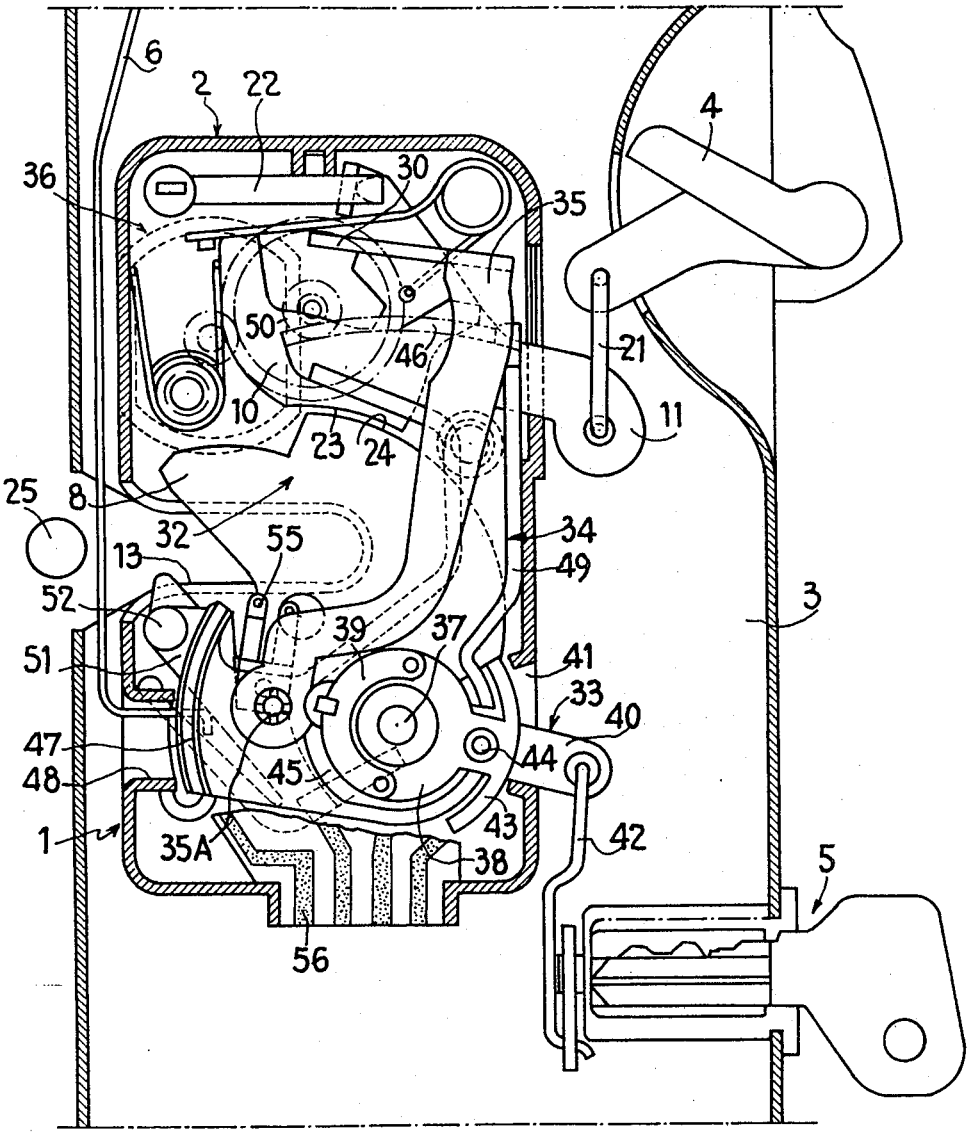
FIG. 1 is a general elevational view, partly in section, of a latch according to the invention.

The latch 1 shown in FIG. 1 is mainly disposed in a parallelepipedic case 2, which is fixed flat against in the edge portion of an automobile vehicle door 3 which is provided with, on one hand, an outer control handle 4, and an inner control button (not shown) for unlatching the latch, and, on the other hand, an outer key 5 and a rod 6 connected to an inner frame pull-member (not shown) for the locking and unlocking of the latch. Hereinafter, the latch will be described in its position shown in FIG. 1 which corresponds to its mounting on a front door of a vehicle. The case 2 has therefore a rectangular shape with its large sides vertical.

Figure 2:
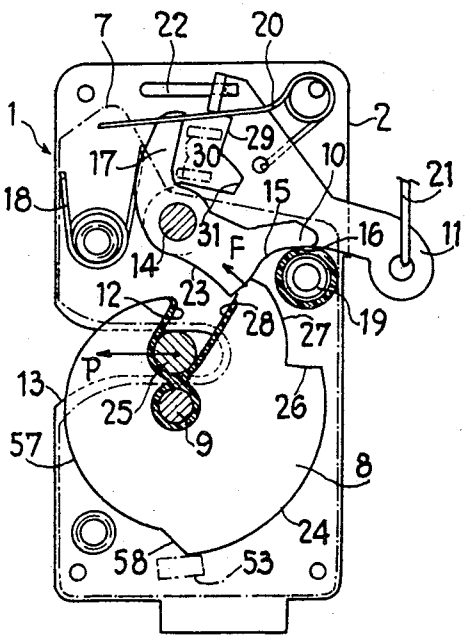
FIG. 2 is an elevational view of the latching mechanism of the latch alone.
Figure 3:
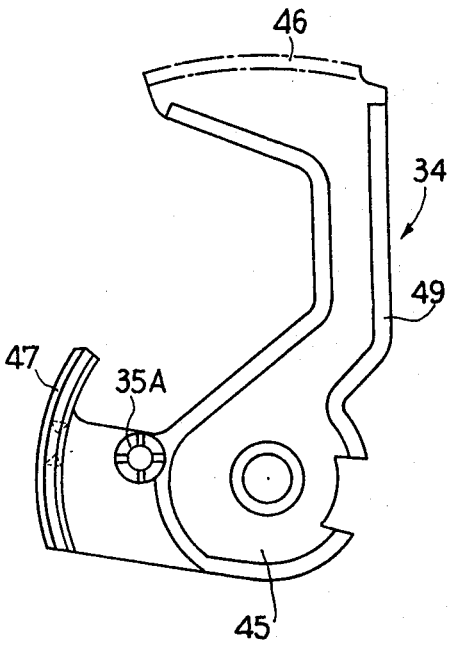
FIGS. 3 to 5 show, to an enlarged scale, some component parts of the latch.
Figure 5:
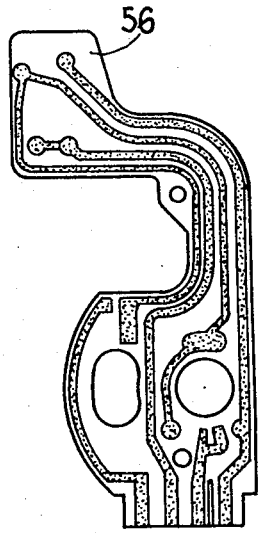

The latching mechanism of the latch 1 shown alone in FIG. 2 is mounted between two identical, parallel and vertical plates 7 contained in the case 2. It comprises a pivotal fork member 8 constituting a bolt, which is journalled on a fixed horizontal pin 9, a pawl 10 and an opening lever 11 extending through a sealing element which closes a slot of the case 2.

The fork member 8 has the general shape of a disc-cam provided with a substantially radially extending recess 12 which extends almost to the pin 9 and crosses a horizontal recess 13 in the plates 7 and the rear side of the case 2 in all the required positions of the fork member. More precisely, the fork member 8 is made from a steel piece in which a central aperture and the recess 12 communicate with each other, and the moulding onto this piece of a lining of plastics material on the periphery of the central aperture and of the recess separates the aperture from the recess by a thin strip of plastics material.

The pawl 10, which is pivotally mounted on another horizontal pin 14 located on the other side of the recess 13 with respect to the pin 9, ie. above the recess 13, comprises a branch provided with a stop surface 15 and a retaining surface 16, and an actuating branch 17. A spring 18 biases the pawl in the clockwise direction towards its active position in which the retaining surface 16 bears against an elastically yieldable stop 19.

In order to move the pawl away from this position, the lever 11 must be pivoted in the counter-clockwise direction. This lever is pivotally mounted on the pin 14 and is biased toward its position of rest by a spring 20. The lever 11 can be pivoted either by means of a knob 4 through a link 21, or by means of an inner control knob through a pull-member 22.

In the unlatched position of the latch shown in FIG. 1, the recess 12 directs its opening toward the entrance of the recess 13. The pawl 10 is withdrawn and bears by a concave surface 23 against a substantially circular surface 24 of maximum radius of the fork member 8 and extending through roughly a quarter of a circumference.

When the door closes, a cylindrical keeper 25 rigid with the body of the vehicle enters into the two recesses 12 and 13 and rotates the fork member 8 in the clockwise direction. The end of the surface 23 of the pawl reaches a position in alignment with a first radial surface 26 of the fork member and, under the action of the spring 18, this surface bears against a surface 27, which is of reduced but increasing radius, of the fork member which extends to the recess 12. The surface 26 is then in facing relation to the stop surface 15 of the pawl and this corresponds to the first latching position of the latch.

When the keeper 25 reaches the closed end of the recess 13, likewise, the surface 15 of the pawl cooperates with the inner edge 28 of the recess 12 and its surface 16 bears against the elastically yieldable stop 19. The latch is then in its second latching position.

In each latching position, the radial surface 26 or 28 of the fork member exerts on the surface 15 of pawl 10 a force F which is substantially directed toward the pin 14. Moreover, the opening force P, in particular due to the compression of the sealing elements of the door, is exerted very close to the pin 9 in contrast to the force F. Consequently, a small force is sufficient to achieve the unlatching. This force is exerted on the branch 17 of the pawl by a surface 29 of the lever 11 through a tab 30 which is part of the locking and unlocking mechanism described hereinafter, and this in the unlocking position of this mechanism. In order to lock the latch, the tab 30 is shifted toward the pin 14 so as to bring it in facing relation to a recess 31 in the lever 11, the pivoting of the latter then becomes inoperative.

When the latch is unlocked, the withdrawal of the pawl 10 releases the fork member 8. When the door is opened, the withdrawal of the keeper from the recess 13 brings this fork member to its initial position and the release of the control knob employed allows the whole of the latching mechanism to return to its position of FIG. 1.

The locking-unlocking mechanism generally designated by the reference numeral 32 and shown in FIGS. 1 and 3 to 5, comprises mainly an input lever 33, an actuating plate 34, a link 35 which terminates in the aforementioned tab 30, and an actuating means constituted by an electric motor or motor-speed reducer unit 36 received in a housing which projects from the front side of the case 2, (which side is located in front of the plane of FIG. 1) and is an integral part of this case.

The lever 33 and the plate 34 are pivotally mounted on a common horizontal pin 37 which is in the vicinity of the lower right corner of the case 2. The lever 33 comprises a disc 38, provided with an elastically yieldable strip 39 having a semi-circular extent, and an extension leg 40 which extends out of the case through a lateral slot 41 in the latter and is connected to the barrel of the key 5 through a rod 42. A screen 43 in the shape of an arc of a circle and rigid with the leg 40 inside the case 2, permanently closes the slot 41 in the course of the movements of the lever 33 between its two stable positions defined by the elastically yieldable cooperation of a spring-loaded ball 44 with two cavities in the adjacent front side of the case.

The plate 34 (FIGS. 1 and 3) has a generally L shape whose corner is mounted on the pin 37 and defines a disc 45 which receives the disc 38 of the lever 33. The vertical branch of the L terminates in a toothed sector 46 and its horizontal branch terminates in a screen 47 in the shape of an arc of a circle which permanently closes the lateral slot 48 in the case 2 opposed to the slot 41. The lower end of the rod 6 is hooked to the middle of this screen 47.

The plate 34 has on the side adjacent the slot 41 a projecting peripheral flange 49 which extends alongside the vertical branch of the L and the disc 45. This flange is interrupted in front of the slot 41 and there extends through the flange in this region, with a marked circumferential clearance, the leg 40 of the lever 33 which abuts against this flange in each of its stable positions. The output gear 50 of the motor-speed reducer unit 36 is located in the case 2 proper and directly engages the toothed sector 46 of the plate 34.

The link 35 carries the tab 30 at its upper end and is pivotally mounted by its lower end portion on a pivot 35A of the horizontal branch of the plate 34 so that the pivoting of the plate in the counterclockwise direction shifts the link 35 downwardly and brings the tab 30 to its locking position and vice versa (FIG. 2). The guiding substantially in translation of the link 35 is ensured, on one hand, by the adjacent surface of the pawl 10, and, on the other hand, by a suitable configuration of the case 2.

Figure 4:
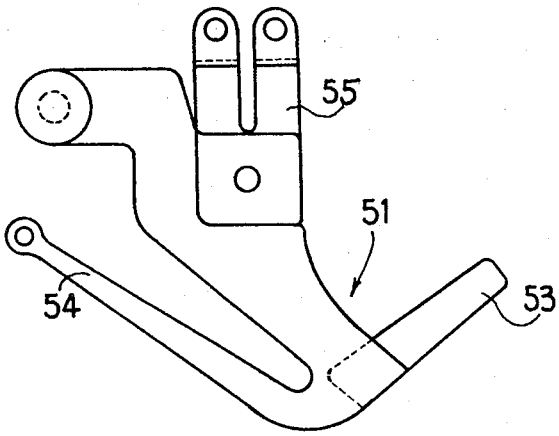

The latch further comprises a lever 51 for detecting an incompletely closed door (FIGS. 1, 2 and 4). This lever is pivotally mounted by one end portion on a horizontal pin 52, located between the recess 13 and the slot 48 of the case 2, and elastically bears against the lower region of the fork member 8 by its other bent end portion 53. This bearing effect is caused by the action of an elastically yieldable extension 54 of the lever 51 whose free end portion abuts against the upper edge of the slot 48. A metal strip 55 is fixed to the middle part of the lever 51. This strip, in the same way as the strip 39 of the lever 33, bears elastically against a plate of a printed circuit 56 (FIGS. 1 and 5) carried by the large inner side of the case 2.

Although this has not been described in detail, all the elements of the latch have in necessary places suitable changes in plane to enable them to carry out their movements.

The locking mechanism 32 operates in the following manner.

The considered vehicle is equipped with a plurality of latches, for example four latches, at least two of which latches include a key 5. The latches which are possibly devoid of a key, in particular on the rear doors, are identical to the others but may be devoid of the lever 33 and the slot 41. The vehicle includes a centralized electric distributor (not shown) which supplies to all the motors 36 the electric power in accordance with the orders it receives. Each printed circuit 56 is connected to the electric distributor and to its light indicating an incompletely closed door (see hereinafter) by a group of cables terminating in a connector which is clipped on the lower part of the case 2. Switches on the dashboard or control panel or in other parts of the vehicle, may also give the central distributor various locking or unlocking orders, for example for unlocking the latches when all of the latches are not in their second closing position.

Irrespective of the position of the latching mechanism, it will be assumed that the door is unlocked at the start, ie. the tab 30 is in facing relation to the surface 29 (FIG. 2) of the lever 11, which corresponds to the upper position of the link 35 (FIG. 1).

The start of the actuation of any key 5 brings the strip 39 of the lever 33 in contact with tracks of the printed circuit 56 which result in the supply of power to all the motors 36 for a pre-determined period of time t. During this time t, each motor drives in rotation its plate 34 and changes the position of the link 35 and brings the tabs 30 in facing relation to the recess 31 of the levers 11, which simultaneously locks all the latches. This movement is rather rapid so as to be carried out before the leg 40 of the actuated lever 33 takes up the clearance which separates the leg from the flange 49 of the associated plate 34. Thereafter, the lever 33 does not have to drive the gear 50 of the motor in rotation and the shifting of the key is very smooth and can continue without effort until the lever 33 reaches its other stable position.

If the electric circuit is defective, the contact established by the strip 39 has no effect. The lever 33 then takes up its angular clearance, engages the flange 49 and itself causes the plate 34 to rotate.

In both cases, the plate 34 may also be shifted manually in either direction by the rod 6 which acts on the end 47 of its horizontal branch.

When the latch is open (FIG. 1) or closed at the first stage or safety stage, the end 53 of the lever 51 bears against a circular region 57 of minimum diameter of the fork member 8 which extends from the recess 12 to the extent of about half a circumference and is then connected to the surface 24 of maximum diameter by a ramp 58.

In this position, the strip 55 actuates, through the printed circuit 56, a warning light placed on the dashboard of the vehicle. When the fork member 8, in rotating in the clockwise direction, reaches the second stage of latching (FIG. 2), the end 53 of the lever 51 rises on the ramp 58 and bears against the surface 24, which turns off the indicator of a bad closing of the door.

In this embodiment, the ratio of the reduction in the speed of the electric actuating means is so chosen that, in the event of an electric breakdown, the driving of the motor, brought about by the displacement of the locking lever 33, requires a shifting force on the part of the key 5 or the interior pull-member which is small enough to ensure that the operation is pleasant for the user. The modification shown in FIG. 6 completely eliminates this manual driving of the motor 36.

Figure 6:
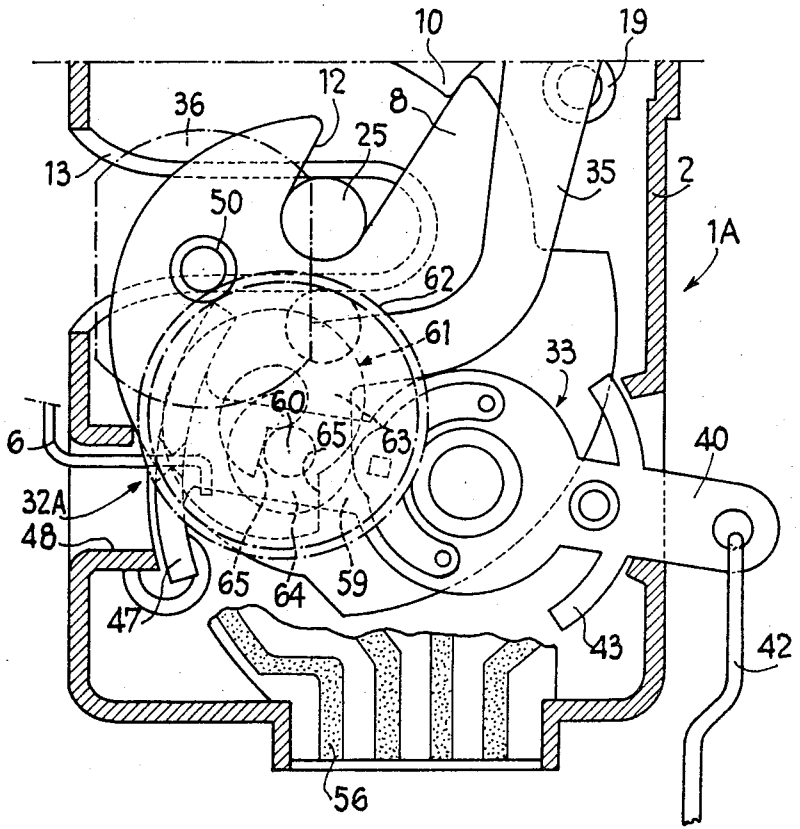
FIG. 6 is a partial elevational view, partly in section, of a modification of the latch shown in FIG. 1.

The latch 1A shown in FIG. 6 has the same latching and unlatching mechanism as the latch 1 and its locking mechanism 32A comprises the same locking link 35. However, the lower end of this link is directly pivotally mounted on an additional leg 59 of the lever 33 opposed to the leg 40. The pivot pin 60, which is located as in the first embodiment, forms a cylindrical stud received in the groove 61 of a cam wheel 62 which is rotatably mounted in the case 2. The outer periphery of this wheel is toothed and engages the output gear 50 of the motor 36 which is located in the region of the recess 13. The groove 61 comprises a turn of a spiral 63 the two ends of which are interconnected by a radial straight segment 64.

In each of the two positions of the locking mechanism, the stud 60 is in abutment with one end of the segment 64. Thus, if beginning of the movement of the lever 33, shifted by the key, does not result in a supply of power to the motors 36, continuing this movement shifts the link 35 which requires negligible force, without driving the wheel 62 and consequently the motor 36. In the opposite case, each motor 36 drives its wheel 62 in rotation and this shifts all the links 35, the radial surfaces 65 which terminate the spiral 63 limiting this rotation to a complete rotation, so that the position of the wheel 62 is identical whether the latch is locked or unlocked.

In this modification, it will be understood that the central distributor does not have to supply power to the motor of the latch which is actuated manually by its key or its inner pull-member. Further, the ratio of the speed reduction between the angle of rotation of the motor and the angle of rotation of the locking lever 33 may be much greater than in the preceding embodiment, so that it is possible to employ a weaker motor or to have available a much greater force for actuating the locking mechanism by the motor without penalizing the forces for actuating this mechanism in the event of a breakdown in the supply of power to the motor.

In each modification, the time for changing the position of the locking mechanism by means of the motor 36 is of the order of half a second, ie. of the same order of magnitude as the time required for turning a key 5 half a turn. Consequently, the following modification (not shown) may be envisaged. The lever 33 is converted into a monostable lever biased toward a single stable position which is an electrically inactive position. By rotating the key of any latch, the corresponding lever is brought to an unstable position and this closes the circuit of all the motors 36 during the time required to change the state of the locking mechanism. Then, the key is released, the lever 33 returns to its neutral position, and the supply of power to the motors 36 is cut off. This permits the elimination of the central distributor, at least in respect of the simple locking and unlocking by means of a key.

In this modification, as before, a possible extra travel of the lever 33 manually actuates the corresponding locking mechanism. This type of operation is made possible by an obvious modification of the clearances between the leg 40 of the levers 33 and the flange 49 of the plates 34.

In each modification, the latching mechanism, which is subjected to high stresses, is preferably of steel whereas the locking mechanism, which is subjected only to low stresses, may be mainly constructed of plastics material. Its screens 43 and 47 and the sealing element of the lever 11 ensure a good sealing of the latch against dust and streaming water.

It will be understood that each modification of the locking mechanism may be combined in the same latch case with different types of latching and unlatching mechanisms.

Having now described my invention what I claim as new and desire to secure by Letters Patent is:

1. A latch, in particular for an automobile vehicle door, said latch comprising a case, a latching mechanism, a locking mechanism associated with the latching mechanism for locking the latching mechanism, an actuating means including an electric motor and associated with the locking mechanism for actuating the locking mechanism, a key, means for connecting the key to the locking mechanism for manually actuating the locking mechanism and means electrically connecting the key to an electric circuit for controlling the supply of current to the actuating means, the motor having an output gear which is located in said case and directly drives an element of the locking mechanism, wherein said means for electrically connecting the key to the electric circuit comprises a switching lever for controlling the supply of current to the actuating means, said case carrying a printed circuit and said lever carrying a metal strip which is elastically applied against said printed circuit, wherein the switching lever is also part of said means for connecting the key to the locking mechanism for manually actuating the locking mechanism, wherein the switching lever is connected to said element directly driven by the output gear of the motor through a connection means having a lost motion travel at least in each of the positions for locking and unlocking the locking mechanism.

2. A latch according to claim 1, wherein said locking mechanism comprises a pivotal plate mounted on a pivot pin and pivotable between two abutments, the plate comprising a toothed sector engaged with said output gear of the motor, the switching lever being journalled on said pivot pin and pivotable between said two abutments for said plate with an angular clearance.

3. A latch according to claim 1, comprising a cam which is engaged with said gear and comprises a groove which has a spiral-shaped portion having two ends which are interconnected by a radial straight segment, said switching lever comprising a stud engaged in said groove.

4. A latch according to claim 3 wherein the switching lever has a single stable position which is an inoperative middle position of the switching lever.

5. A latch according to claim 1, having two latching positions and comprising a pivotal fork member which defines a cam surface, a movable warning lever mounted in the case, means for biasing the warning lever against the cam surface of the fork member, whereby the warning lever changes position when the latch reaches a second latching position of the latch, an alarm device being connected to the warning lever.

6. A latch according to claim 5, wherein the warning lever carries a metal strip and means elastically applies the metal strip against a printed circuit carried by the case of the latch.

7. A latch according to claim 1, comprising a pivotal fork member, said fork member defining an aperture for pivotally mounting the fork member in the case and a recess for receiving a keeper associated with the latch and communicating with said aperture, and a localized coating of plastics material on the aperture and the recess, said coating separating said aperture and recess.

8. A latch according to claim 1, wherein the motor is received in a housing which projects from the case of the latch and is an integral part of the case.

* * * * *